US006935883B2

(12) United States Patent
Oddsen, Jr.

(10) Patent No.: US 6,935,883 B2
(45) Date of Patent: Aug. 30, 2005

(54) QUICK INTERCONNECTION SYSTEM FOR ELECTRONIC DEVICES

(75) Inventor: Odd N. Oddsen, Jr., Easton, PA (US)

(73) Assignee: Innovative Office Products, Inc., Easton, PA (US)

( * ) Notice: Subject to any disclaimer, the term of this patent is extended or adjusted under 35 U.S.C. 154(b) by 0 days.

(21) Appl. No.: 10/417,711

(22) Filed: Apr. 17, 2003

(65) Prior Publication Data

US 2004/0014349 A1 Jan. 22, 2004

Related U.S. Application Data

(60) Provisional application No. 60/374,951, filed on Apr. 24, 2002.

(51) Int. Cl.[7] ..... H01R 13/64

(52) U.S. Cl. ..... 439/374; 439/929; 439/534; 248/274.1; 248/920

(58) Field of Search ..... 439/374, 929, 439/534; 248/917–924, 274.1, 118.3

(56) References Cited

U.S. PATENT DOCUMENTS 6,076,785 A * 6/2000 Oddsen, Jr. ..... 248/118.3
6,366,458 B1 4/2002 Yoshida et al.
6,400,560 B1 * 6/2002 Chian ..... 361/681
6,409,134 B1 * 6/2002 Oddsen, Jr. ..... 248/274.1
6,478,274 B1 * 11/2002 Oddsen, Jr. ..... 248/274.1
6,505,988 B1 * 1/2003 Oddsen, Jr. ..... 403/110
6,702,604 B1 * 3/2004 Moscovitch ..... 439/374

* cited by examiner

*Primary Examiner*—Gary Paumen
(74) *Attorney, Agent, or Firm*—Lerner, David, Littenberg Krumholz & Mentlik

(57) ABSTRACT

A connector system for an electronic device having a plurality of connectors includes a mounting bracket adapted to be attached to the electronic device. The mounting bracket includes a plurality of pins extending outwardly therefrom. A plate is provided with a plurality of openings adapted to receive a corresponding one of the pins for releasably securing the mounting bracket to the plate. A connector block is coupled to the plate, the connector block including a plurality of openings each adapted to secure a connector therein. The connectors within the connector block simultaneously coupling with the connectors of the electronic device when the mounting bracket is secured to the plate.

45 Claims, 5 Drawing Sheets

QUICK INTERCONNECTION SYSTEM FOR ELECTRONIC DEVICES

CROSS REFERENCE TO RELATED APPLICATIONS

The present application claims the benefit of Provisional Application No. 60/374,951, filed on Apr. 24, 2002, entitled "Quick Interconnection System for Electronic Devices", the disclosure of which is incorporated herein by reference.

BACKGROUND OF THE INVENTION

The present invention relates in general to a quick interconnection system for electronic devices, and more particularly, to an electrical connector system for flat screen displays and the like.

A flat screen display is an electronic device which displays alphanumeric characters, pictures and graphic images. Often, flat screen displays use liquid crystal technology for producing high quality picture images. The flat screen display is most often associated with a computer having extensive industrial and residential application. The flat screen display has become increasingly popular for industrial applications in view of its small size and reduced weight compared to conventional CRT monitors. In this regard, flat screen displays are only a few inches thick as compared to conventional monitors which are often 12 inches in thickness or greater. For this reason, flat screen displays require a supporting bracket in order to support the flat screen display in a user orientation.

One known bracket is an articulating arm to which the flat screen display is mounted at one end via a mounting bracket. The articulating arm allows the user to position the flat screen display in multiple horizontal and vertical positions covering a three dimensional space.

The flat screen display is connected to a desktop or a notebook computer via a number of electrical cables to supply, for example, DC power, digital video signals, analog video signals, etc. It is known in the computer industry to provide various types of pin connectors, both male and female, as well as other types of connectors to provide the requisite input and output signals to the flat screen display, as well as DC power. In the event of failure of the flat screen display, it is required that each of the connectors be disconnected, followed by removal of the flat screen display, and then reconnection of the connectors and attachment of the flat screen display to its mounting or supporting bracket. This process of replacing a flat screen display is time consuming and can potentially cause damage to one of the connectors if improperly aligned.

In certain applications, the flat screen display is used to display ongoing process information. In medical applications, the flat screen display may be used to display conditions of the patient during and after surgical procedures such as in the operating room and intensive care unit. In addition, in financial markets, the flat screen display may be used to display real time stock values during stock trading. In the event of failure of the flat screen display, it is essential that the display be replaced with the minimum of down time.

There is therefore an unsolved need for a quick interconnection system for electronic devices, and in particular, flat screen displays, to allow replacement of inoperative displays in a quick and easy manner.

SUMMARY OF THE INVENTION

In accordance with one embodiment of the present invention there is disclosed an interconnection system for an electronic device having a first connector, the system comprising a mounting bracket adapted to be attached to an electronic device, a connector plate, a second connector coupled to the plate, and an attachment device in operative association with the mounting bracket and the plate, the first and second connectors connecting with each other when the mounting bracket and the plate are attached to one another by the attachment device.

In accordance with another embodiment of the present invention there is disclosed an interconnection system for an electronic device having a plurality of first connectors, the system comprising a mounting bracket adapted to be attached to the electronic device, the mounting bracket having a plurality of pins extending therefrom; a plate having a plurality of openings adapted to receive a corresponding one of the pins for releasably securing the mounting bracket to the plate; a connector block coupled to the plate, the connector block including a plurality of openings each adapted to secure a second connector therein, the connector block coupling the second connectors with the first connectors when the mounting bracket is secured to the plate.

In accordance with another embodiment of the present invention there is disclosed an interconnection system for a flat screen display having a plurality of first connectors, the system comprising a mounting bracket adapted to be attached to the display, the mounting bracket including a plurality of pins having enlarged ends extending outwardly therefrom; a plate having a pair of spaced apart openings and a key hole shaped opening, the openings alignable with a corresponding one of the pins for receiving the pins therein whereby the mounting bracket is releasably attached to the plate; a connector block coupled to the plate, the connector block having a plurality of openings each adapted to secure a second connector therein matable with one of the first connectors, the second connectors simultaneously connecting with a corresponding one of the first connectors when the mounting bracket is secured to the plate; and a locking device releasably locking the mounting bracket to the plate.

In accordance with another embodiment of the present invention there is disclosed a method for mounting an electronic device while simultaneously mating at least a pair of connectors, the method comprising attaching a mounting bracket to an electronic device having at least one first connector, attaching at least one second connector to a connector plate, and attaching the connector plate to the mounting bracket while simultaneously mating the first and second connectors together.

In accordance with another embodiment of the present invention there is disclosed a method for coupling an electronic device having a plurality of first connectors with a corresponding plurality of second connectors, the method comprising mounting a mounting bracket to an electronic device having a plurality of first connectors, attaching a plurality of second connectors to a connector plate, displacing the mounting bracket relative to the connector plate, and attaching the mounting bracket to the connector plate while simultaneously mating the plurality of first and second connectors together.

BRIEF DESCRIPTION OF THE DRAWINGS

The accompanying drawings, which are incorporated in and form a part of the specification, illustrate the embodiments of the present invention and, together with the description, serve to explain the principles of the invention.

DETAILED DESCRIPTION OF THE PREFERRED EMBODIMENTS

Figure 1:
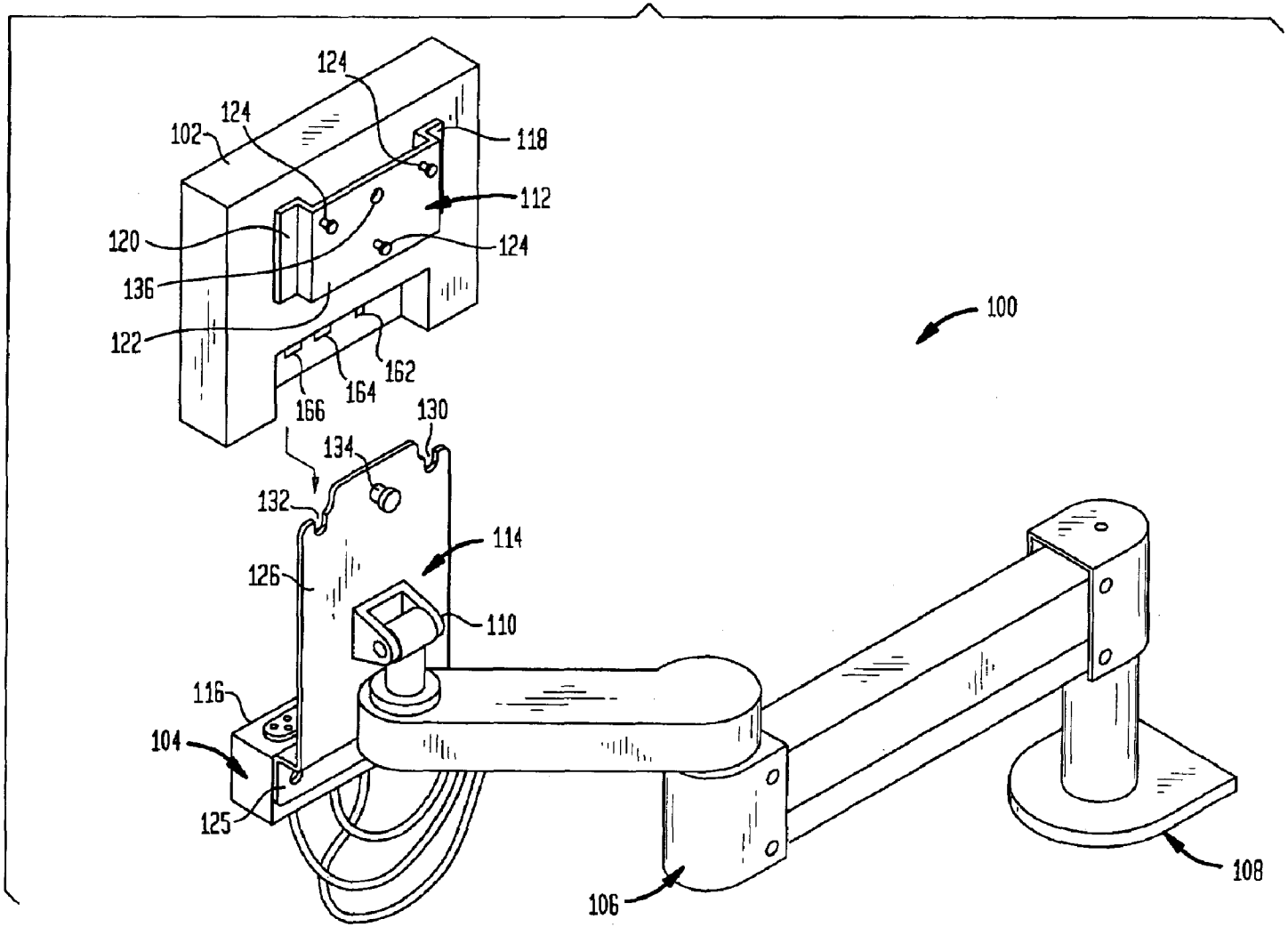
FIG. 1 is a perspective view of a flat screen display incorporating a quick interconnection system in accordance with one embodiment of the present invention.

In describing the preferred embodiments of the invention illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

Referring to the drawings wherein like reference numerals represent like elements, there is shown in FIG. 1 a flat screen display system generally designated by reference numeral 100. The system 100 includes an electronic device such as a flat screen display 102, a quick interconnection system generally designated by reference numeral 104 and an articulating support arm generally designated by reference numeral 106. Other electronic devices include notebook computers, CRT displays, VCR's or the like.

The articulating support arm 106 includes a support bracket 108 adapted to rotationally support the support arm 106 on a supporting surface. One suitable support bracket 108 for this purpose is disclosed in Applicant's copending patent application Ser. No. 09/406,531 entitled "Configurable Mount" filed on Sep. 27, 1999, the disclosure of which is incorporated herein by reference. The other end of the support arm 106 includes, by way of example, a tilter 110. The tilter 110 is adapted to be coupled to the flat screen display 102 to enable its rotation and tilting about two perpendicular axes. One known tilter 110 is disclosed in U.S. Pat. No. 6,505,988, entitled "Tilter For Positioning Electronic Device", the disclosure of which is incorporated herein by reference. Known articulating arms 106 are disclosed in Applicant's U.S. Pat. No. 6,409,134 entitled "Arm Apparatus For Mounting Electronic Devices With Cable Management System"; application Ser. No. 10/061,880 entitled "Modular Mounting Arm" filed on Feb. 1, 2002; U.S. Pat. No. 6,478,274 entitled "Arm Apparatus For Mounting Electronic Devices"; and U.S. Pat. No. 6,076,785, entitled "Ergonomic Sit/Stand Keyboard Support Mechanism"; the disclosures of which are incorporated herein by reference.

The quick interconnection system 104 generally includes three components, an electronic device mounting bracket 112, a quick release plate 114 and a connector block 116. The mounting bracket 112 is, by way of one example, a U-shaped bracket having a pair of upstanding side walls 118, 120 spaced apart by a flat plate 122. In the embodiment disclosed in FIG. 1, an attachment device in the nature of, for example, three pins 124 having enlarged heads or ends are attached to extend outwardly from the plate 122 in a triangular orientation. The mounting bracket 112 is attached to the back of the flat screen display 102 by means of the side walls 118, 120. Typically, the side walls 118, 120 will have lateral flanges through which a bolt, screw or other fastening device may attach to a threaded opening provided within the back of flat screen display 102.

Figure 2:
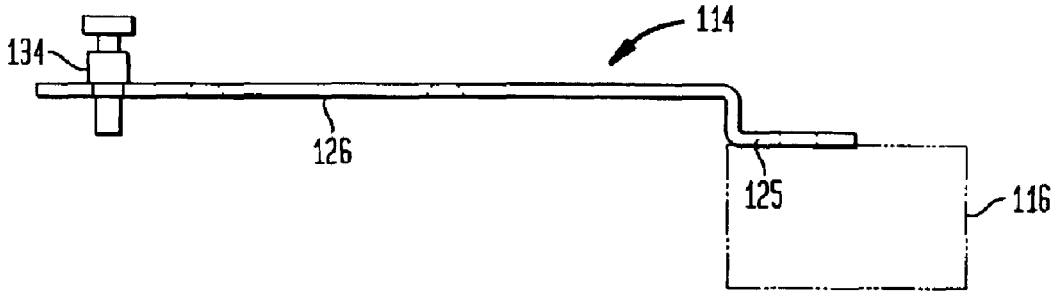
FIG. 2 is a side elevational view of a bracket adapted for use in the quick interconnection system.
Figure 3:
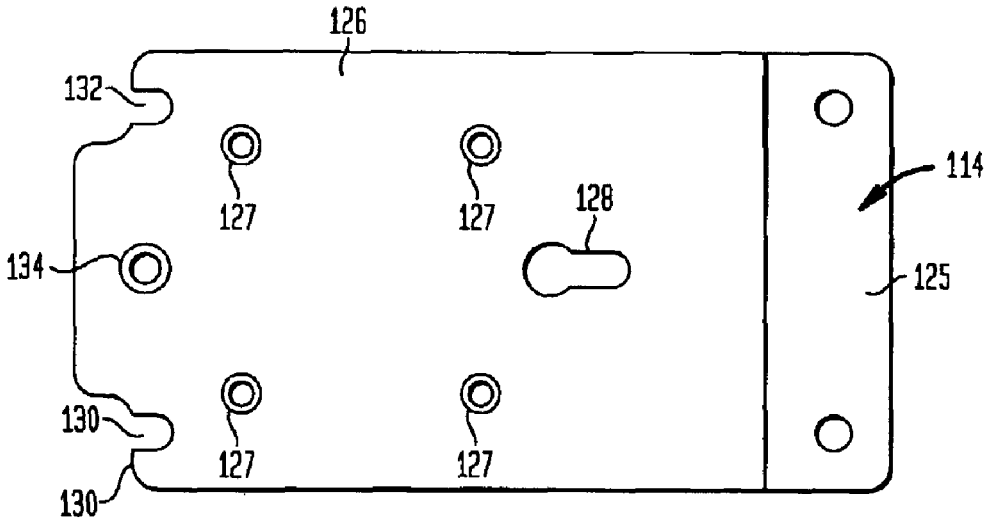
FIG. 3 is a top plan view of the bracket.

The quick release plate 114, as best shown in FIGS. 2 and 3, is constructed from a rectangular member having a short leg 125 and a long leg 126 arranged parallel thereto by a short transversely arranged connecting leg. The short leg 125 is provided with a number of openings which allow the short leg to be fixedly attached to the connector block 116 using bolts, screws and the like received within corresponding threaded openings within the connector block. The long leg 126 is also provided with a plurality of openings 127 to allow the plate 114 to be attached to the tilter 110, also using suitable bolts or screws.

The long leg 126 is provided with a key hole-shaped opening 128 and a pair of spaced apart U-shaped openings 130, 132 disposed along the leading edge 133 of the long leg 126. The key hole-shaped opening 128 and U-shaped openings 130, 132 are spaced apart in a triangular arrangement to correspond to the spaced apart arrangement of the connector pins 124 which protrude from the mounting bracket 112. The plate 114 is also provided with a spring biased locking pin 134 which, in the preferred embodiment, is normally biased to extend outwardly. The locking pin 134 is alignable with a hole 136 provided within the mounting bracket 112.

Figure 4:
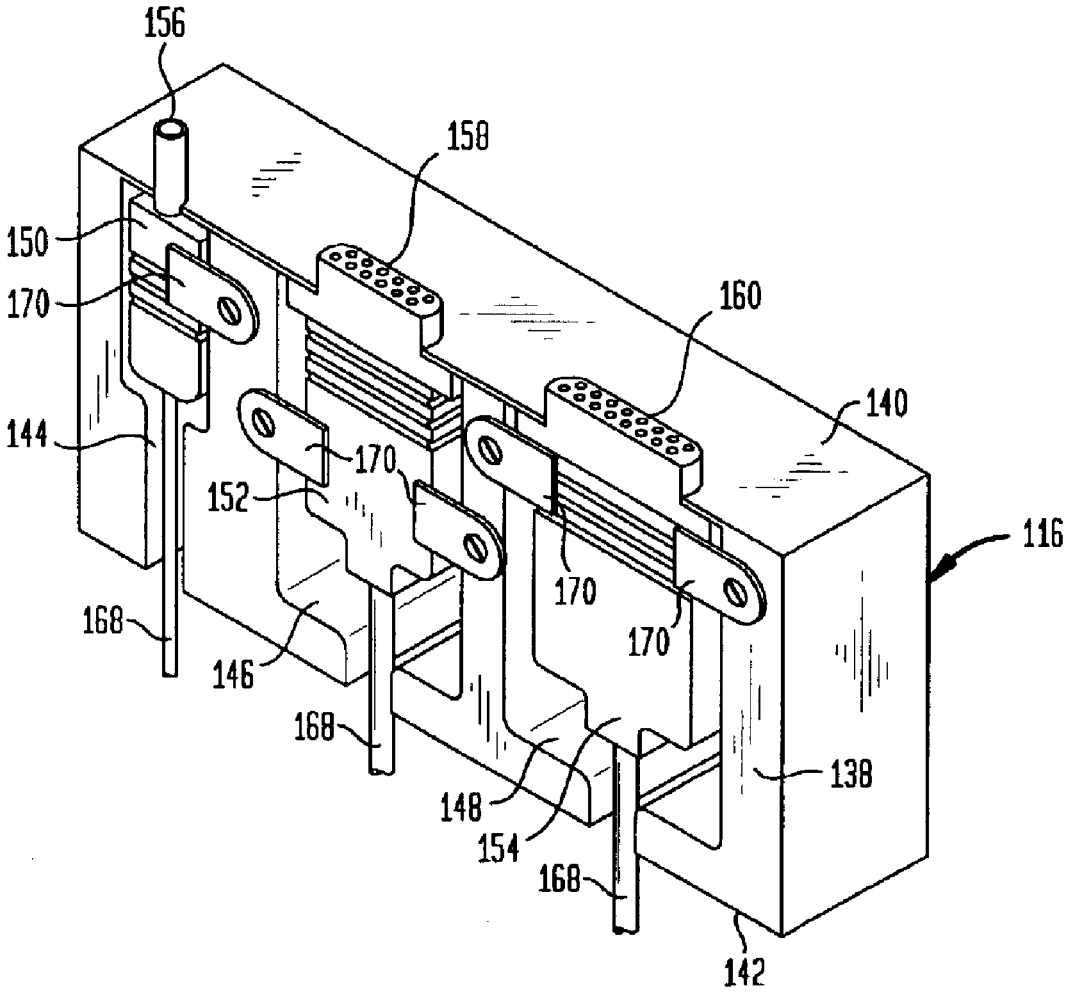
FIG. 4 is a perspective view of a connector block constructed in accordance with one embodiment of the present invention.

The connector block 116 is shown in FIG. 4 in accordance with one embodiment of the present invention. The connecting block 116 includes a front wall 138 and spaced apart top and bottom walls 140, 142. In the embodiment shown, three recessed openings 144, 146, 148 are cut into the front wall 138 and extend to corresponding openings provided in the top and bottom walls 140, 142. The number of openings 140, 146, 148 will depend upon the number of connectors required for the particular electronic device to be used with the quick interconnection system 104 in accordance with the present invention. In the case of the flat screen display 102, it is contemplated that three openings will be provided. In this regard, opening 144 is adapted to receive connector 150 for supplying DC power to the flat screen display 102. Opening 146 is adapted to receive connector 152 for supplying digital video signals to the flat screen display 102. Opening 148 is configured so as to accept connector 154 for supplying analog video signals to the flat screen display 102. Each of the connectors 150, 152, 154 have corresponding protruding portions 156, 158, 160 which extends above the top wall 140. The protruding portions 156, 158, 160 are configured to mate with corresponding connectors 162, 164, 166 provided on the back of the flat screen display 102 as shown in FIG. 1. By way of example, the connectors may be in the nature of RCA connectors, male pin connectors, female pin connectors and the like. Each of the connectors 150, 152, 154 are provided with electrical cables 168 which extend outwardly through the openings provided in the bottom wall 142. Each of the cables 168 will be provided with an end connector (not shown) at its terminal end for connection to the computer for operation of the flat screen display.

The connectors 150, 152, 154 may be secured within the openings 144, 146, 148 by any suitable means. By way of example, a plurality of small clips 170 are secured to the front wall 138 of the connector block 166 using suitable screws or bolts. Each of the clips 170 have a portion which extends overlying a portion of the connector 150, 152, 154 so as to secure same within its corresponding opening 144, 146, 148. If desired, the front wall 138 may be provided with a recessed portion sized and shaped to receive a corresponding clip 170 thereby orienting the location of the clip at a predetermined location.

Figure 5:
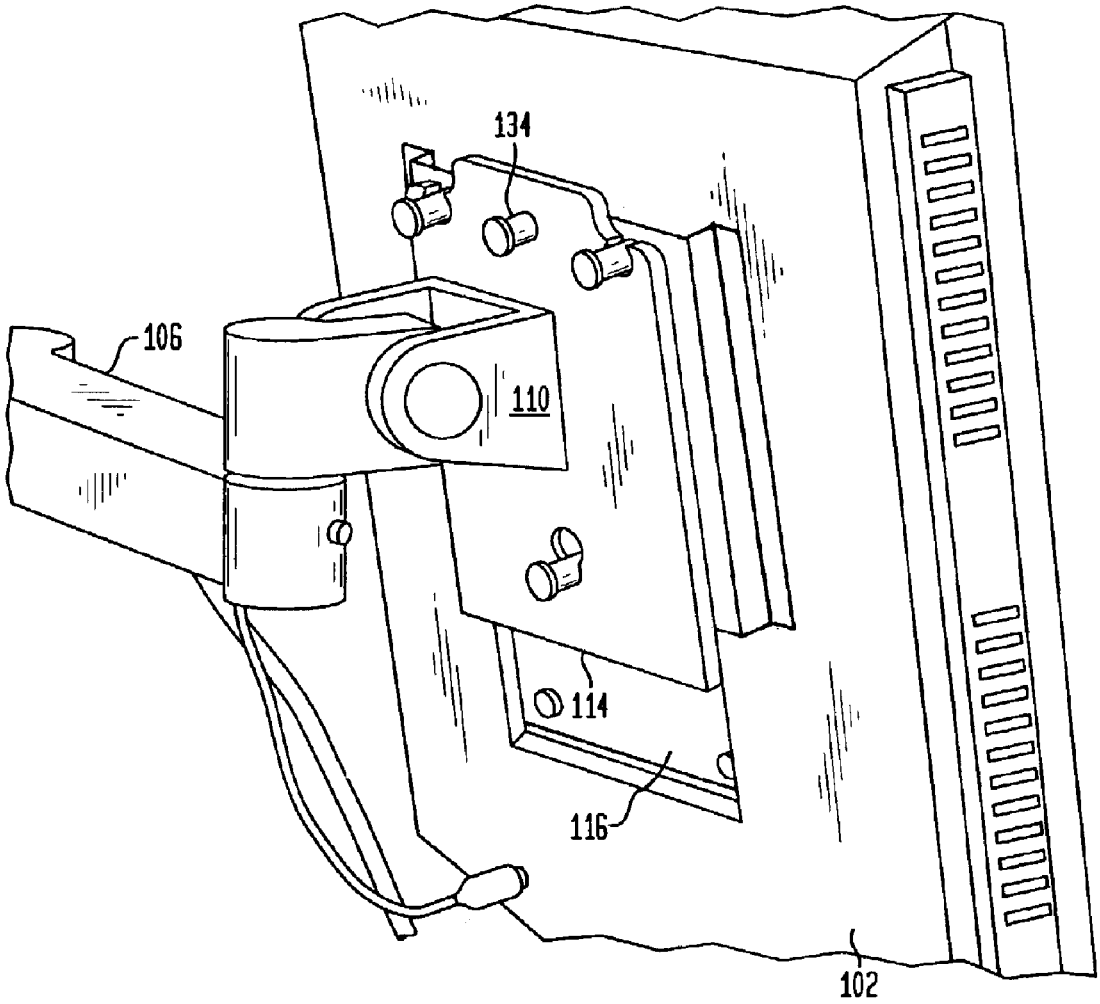
FIG. 5 is a perspective view showing a flat screen display attached to an articulating arm using the quick interconnection system.

As previously described, the connector block 116 is attached to the plate 114, which in turn, is connected to the tilter 110. The mounting bracket 112 is attached to the back of the flat screen display 102. The flat screen display 102 is coupled to the quick connection system 104 by first aligning the connecting pins 124 with a corresponding one of the U-shaped openings 130, 132 and key hole-shaped opening 128. At the same time, the locking pin 134 is aligned with its corresponding hole 136 within the mounting bracket 112. The flat screen display 102 is advanced until the mounting bracket 112 is approximate or in contact with the plate 114. At this point, the connecting pins 124 will be extended through a corresponding one of the openings 128, 130, 132, with the connectors 162, 164, 166 on the flat display screen 102 overlying and in alignment with the connectors 150, 152, 154 within the connector block 116. The downward movement of the flat screen display 102 will result in mating of the connectors with the locking pin 134 engaging the hole 136 thereby locking the flat screen display in electrical and mechanical connection to the connector block 116 as shown in FIG. 5. The key hole-shaped opening 128 ensures that the connectors on the flat screen display 102 and connector block 116 mate during downward displacement of the flat screen display. The U-shaped openings 130, 132 are used for alignment purposes so as to effect the alignment with the connecting pins 124.

The flat screen display 102 can be detached from the connector block 116 using the reverse procedure. In this regard, the locking pin 134 is retracted from its spring biased position so as to withdraw same from within the hole 136 within the mounting bracket 112. The flat screen display 102 is then raised vertically to disconnect the connectors as well aligning the enlarged head of the connector pin 124 with the enlarged opening in the key hole-shaped opening 128. The flat screen display 102 is now disconnected whereupon a new flat screen display may be replaced and electrically connected to the computer via the quick interconnect system 104 as previously described. It should be appreciated that replacing a defective flat screen display 102 using the quick interconnection system 104 of the present invention is relatively quick and takes a minimal amount of time.

Figure 6:
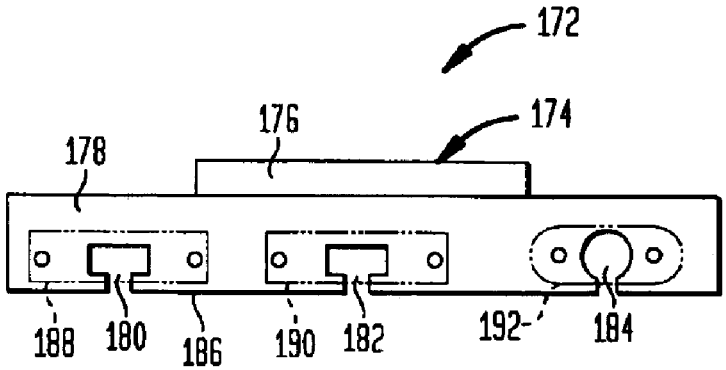
FIG. 6 is a top plan view of a connector block constructed in accordance with another embodiment of the present invention.
Figure 7:
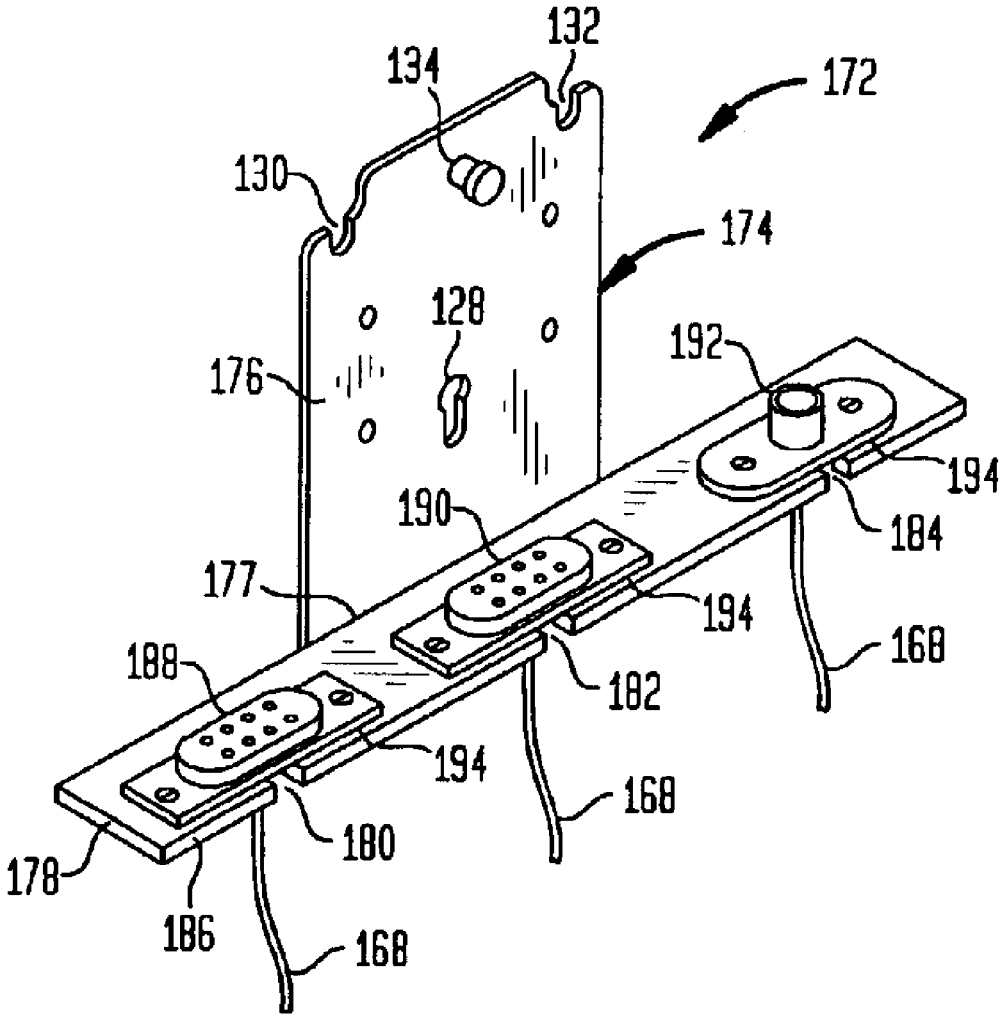
FIG. 7 is a perspective view of the connector block as shown in FIG. 6.

Referring now FIGS. 6 and 7, there is disclosed a quick interconnection system 172 constructed in accordance with another embodiment of the present invention. In the interconnection system 172, the previously described plate 114 and connector block 116 are integrally formed into a single connector mounting bracket 174. The connector mounting bracket 174 includes a generally flat rectangular plate 176 having a similarly arranged key hole-shaped opening 128, a pair of spaced apart U-shaped openings 130, 132 and a locking pin 134 as thus far described. An elongated connector support plate 178 is attached to the bottom edge 177 of the plate 176. The connector support plate 178 which functions as a connector block can be integrally formed with the plate 176 being arranged traversely thereto by bending. However, the connector support plate 178 may be formed as a separate component from plate 176, being joined thereto by, for example, welding, brazening or other suitable means. The connector support plate 178 is provided with a plurality of spaced apart openings 180, 182, 184 which communicate with the front edge 186 of the connector support plate. The openings 180, 182, 184 are sized and shaped to accommodate passage of cables 168 and to receive the body portion of connectors 188, 190, 192. A peripheral portion of the connectors 188, 190, 192, via a respective flange 194, overlies a portion of the connector support plate 178. Each of the flanges 194 are provided with openings for attaching the connectors 188, 190, 192 to the connector support plate 178 using suitable screws or bolts threadedly engaging corresponding openings. It should therefore be appreciated that the configuration, shape and number of openings 180, 182, 184 will be so determined based upon the construction and nature of the connectors 188, 190, 192 to be used with respect to the electronic device, and in particular, the flat screen display 102.

The connector mounting bracket 174 is attached to the tilter 110 in a manner as previously described. The flat screen display 102 can be electrically coupled to the connectors 188, 190, 192 in the manner as previously described with respect to the operation of the quick interconnection system 104.

Although the invention herein has been described with reference to particular embodiments, it is to be understood that these embodiments are merely illustrative of the principles and applications of the present invention. For example, although the attachment device has been described as constructed of three pins 124 and corresponding openings; other arrangements are contemplated to provide the same function, for example, posts and restricted ball sockets and the like. It is therefore to be understood that numerous modifications may be made to the illustrative embodiments and that other arrangements may be devised without departing from the spirit and scope of the present invention.

What is claimed is:

1. An interconnection system for an electronic device having a first connector, said system comprising a mounting bracket adapted to be attached to an electronic device, a connector plate including first and second spaced apart legs, a connector block attached to one of said legs, a second connector attached to said connector block, and an attachment device in operative association with said mounting bracket and said plate, said first and second connectors connecting with each other when said mounting bracket and said plate are attached to one another by said attachment device.

2. The interconnection system of claim 1, further including a support arm coupled to said plate.

3. The interconnection system of claim 2, further including a tilter assembly attaching said support arm to said plate.

4. The interconnection system of claim 1, wherein said connector block includes a plurality of openings, each of said openings adapted for securing one of a plurality of second connectors therein.

5. An interconnection system for an electronic device having a plurality of first connectors, said system comprising a mounting bracket adapted to be attached to the electronic device, said mounting bracket having a plurality of pins extending therefrom; a plate having a plurality of openings adapted to receive a corresponding one of said pins for releasably securing said mounting bracket to said plate; a connector block coupled to said plate, said connector block including a plurality of openings each adapted to secure a second connector therein, said connector block coupling said second connectors with said first connectors when said mounting bracket is secured to the plate.

6. The interconnection system of claim 5, wherein said openings comprise at least one keyhole shaped opening and two U-shaped openings.

7. The interconnection system of claim 6, wherein said openings are arranged in a triangle.

8. The interconnection system of claim 6, wherein each of said pins include an enlarged head adapted to be captured within one of said openings.

9. The interconnection system of claim 5, wherein said plate comprises first and second parallel spaced apart legs, said first leg being shorter than said second leg.

10. The interconnection system of claim 9, wherein said connector block is attached to said short leg.

11. The interconnection system of claim 5, further including a plurality of second connectors attached to said connector block.

12. The interconnection system of claim 5, further including a flat screen display attached to said mounting bracket.

13. The interconnection system of claim 5, wherein said mounting bracket comprises a U-shaped bracket.

14. The interconnection system of claim 5, wherein said plate and said connector block are integrally formed.

15. The interconnection system of claim 5, wherein said plate comprises a first member and a second member attached transversely thereto, said second member forming said connector block.

16. An interconnection system for a flat screen display having a plurality of first connectors, said system comprising a mounting bracket adapted to be attached to the display, said mounting bracket including a plurality of pins having enlarged ends extending outwardly therefrom; a plate having a pair of spaced apart openings and a key hole shaped opening, said openings alignable with a corresponding one of said pins for receiving said pins therein whereby said mounting bracket is releasably attached to said plate; a connector block coupled to said plate, said connector block having a plurality of openings each adapted to secure a second connector therein matable with one of said first connectors, said second connectors simultaneously connecting with a corresponding one of said first connectors when said mounting bracket is secured to said plate; and a locking device releasably locking said mounting bracket to said plate.

17. The interconnection system of claim 16, further including a plurality of second connectors attached to said connector block.

18. The interconnection system of claim 16, further including a flat screen display attached to said mounting bracket.

19. The interconnection system of claim 16, wherein said mounting bracket comprises a U-shaped bracket.

20. The interconnection system of claim 16, wherein said openings are arranged in a triangle.

21. The interconnection system of claim 16, wherein said plate comprises first and second spaced apart legs; said connector block attached to one of said legs.

22. The interconnection system of claim 16, wherein said plate and said connector block are integrally formed.

23. The interconnection system of claim 22, further including a plurality of second connectors attached to said connector block.

24. The interconnection system of claim 16, further including a support arm coupled to said plate.

25. The interconnection system of claim 16, wherein said locking device releasably engages a hole within said mounting bracket.

26. A method for mounting an electronic device while simultaneously mating at least a pair of connectors, said method comprising attaching a mounting bracket to an electronic device having at least one first connector, attaching at least one second connector to a connector plate, attaching said connector plate to said mounting bracket while simultaneously mating said first and second connectors together, and providing a plurality of pins extending from said mounting bracket and a corresponding plurality of openings in said connector plate, each of said openings receiving a corresponding one of said pins for releasably attaching said mounting bracket to said connector plate.

27. The method of claim 26, wherein said electronic device includes a plurality of first connectors and said connector plate includes a corresponding plurality of second connectors, said first and second connectors simultaneously mating upon attachment of said mounting bracket to said connector plate.

28. The method of claim 26, wherein said electronic device comprises a flat screen display.

29. The method of claim 26, further including coupling said connector plate to a support arm.

30. The method of claim 29, further including attaching a tilter assembly between said connector plate and said support arm.

31. The method of claim 26, further including attaching a connector block to said connector plate, and attaching a plurality of second connectors to said connector block.

32. The method of claim 31, wherein said connector block and said connector plate are an integral assembly.

33. The method of claim 26, further including arranging said openings and said pins in a common triangular arrangement.

34. The method of claim 26, wherein said attaching said connector plate to said mounting bracket comprises moving said mounting bracket downwardly relative to said connector plate.

35. A method for coupling an electronic device having a plurality of first connectors with a corresponding plurality of second connectors, said method comprising mounting a mounting bracket to an electronic device having a plurality of first connectors, attaching a plurality of second connectors to a connector plate, displacing said mounting bracket relative to said connector plate, attaching said mounting bracket to said connector plate while simultaneously mating said plurality of first and second connectors together, and providing a plurality of pins extending from said mounting bracket and a corresponding plurality of openings in said connector plate, each of said openings receiving a corresponding one of said pins for releasably attaching said mounting bracket to said connector plate.

36. The method of claim 35, wherein said electronic device comprises a flat screen display.

37. The method of claim 35, further including coupling said connector plate to a support arm.

38. The method of claim 37, further including attaching a tilter assembly between said connector plate and said support arm.

39. The method of claim 35, further including arranging said openings and said pins in a triangular arrangement.

40. The method of claim 35, wherein said connector block and said connector plate are an integral assembly.

41. The method of claim 35, said mounting bracket is moved downwardly relative to said connector plate.

42. An interconnection system for an electronic device having a first connector, said system comprising a mounting bracket adapted to be attached to an electronic device, a connector plate including a first plate and a second plate transversely attached thereto, a second connector coupled to said plate, and an attachment device in operative association with said mounting bracket and said plate, said first and second connectors connecting with each other when said mounting bracket and said plate are attached to one another by said attachment device.

43. The interconnection system of claim 42, wherein said second connector is attached to said second plate.

44. An interconnection system for an electronic device having a first connector, said system comprising a mounting bracket adapted to be attached to an electronic device, a connector plate, a connector block attached to said connector plate, a plurality of second connectors attached to said connector block, and an attachment device in operative association with said mounting bracket and said plate, said first and second connectors connecting with each other when said mounting bracket and said plate are attached to one another by said attachment device.

45. An interconnection system for an electronic device having a first connector, said system comprising a mounting bracket adapted to be attached to an electronic device, a connector plate, a second connector coupled to said plate, and an attachment device in operative association with said mounting bracket and said plate, said first and second connectors connecting with each other when said mounting bracket and said plate are attached to one another by said attachment device, said attachment device including a plurality of pins extending from said mounting bracket and a corresponding a plurality of openings in said connector plate, each of said openings adapted for receiving a corresponding one of said pins for releasably attaching said mounting bracket to said connector plate.

* * * * *

UNITED STATES PATENT AND TRADEMARK OFFICE

CERTIFICATE OF CORRECTION

PATENT NO. : 6,935,883 B2
DATED : August 30, 2005
INVENTOR(S) : Odd N. Oddsen, Jr.

It is certified that error appears in the above-identified patent and that said Letters Patent is hereby corrected as shown below:

Column 8,
Line 41, after "35", please insert -- wherein --.

Signed and Sealed this

Third Day of January, 2006

JON W. DUDAS
*Director of the United States Patent and Trademark Office*